US009615155B2

(12) United States Patent
Yoshida et al.

(10) Patent No.: US 9,615,155 B2
(45) Date of Patent: Apr. 4, 2017

(54) SPEAKER APPARATUS AND SPEAKER BOX

(71) Applicant: Yamaha Corporation, Hamamatsu-shi, Shizuoka-ken (JP)

(72) Inventors: Masao Yoshida, Hamamatsu (JP); Kazuya Atsumi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 217 days.

(21) Appl. No.: 13/912,094

(22) Filed: Jun. 6, 2013

(65) Prior Publication Data

US 2013/0329929 A1 Dec. 12, 2013

(30) Foreign Application Priority Data

Jun. 7, 2012 (JP) ..... 2012-130062

(51) Int. Cl.
*H04R 1/02* (2006.01)
*H04R 1/08* (2006.01)

(52) U.S. Cl.
CPC ..... *H04R 1/025* (2013.01); *H04R 1/02* (2013.01); *H04R 1/086* (2013.01)

(58) Field of Classification Search
CPC . H04R 1/00; H04R 1/02; H04R 1/025; H04R 1/20; H04R 1/026; H04R 1/2803; H04R 1/288; H04R 1/2826; H04R 1/2819; H04R 1/44; H04R 1/023; H04R 1/021; H04R 2499/13; H05K 5/021; H05K 5/068; H05K 5/0213
USPC ..... 381/334, 386, 348, 347, 346, 345, 339, 381/391, 189, 332, 337; 181/149, 155, 181/198, 199, 148
See application file for complete search history.

(56) References Cited

U.S. PATENT DOCUMENTS 3,987,258 A * 10/1976 Tsutsui ..... H04R 1/021 181/149
4,221,929 A * 9/1980 Fukuda ..... H04R 1/025 181/148

(Continued)

FOREIGN PATENT DOCUMENTS

DE 19848242 A1 10/1999
JP 5833392 A 2/1983

(Continued)

OTHER PUBLICATIONS

European Search Report dated Aug. 19, 2013, for EP Application No. 13171017.0, eight pages.

(Continued)

*Primary Examiner* — Xu Mei
*Assistant Examiner* — Ubachukwu Odunukwe
(74) *Attorney, Agent, or Firm* — Morrison & Foerster LLP

(57) ABSTRACT

A speaker apparatus comprises a speaker box SB in which a speaker 51(or 52) is placed, as well as a bass reflex port 22 (or 23), an electric circuit device 40 and a drip-proof wall 16 placed in the speaker box SB. One end of the bass reflex port 22 is open outside the speaker box SB while other end of the bass reflex port 22 is open in the speaker box SB. The drip-proof wall 16 isolates the electric circuit device 40 from the other end of the bass reflex port 22 so that the speaker apparatus can prevent water droplets intruding into the speaker box SB through the bass reflex ports 22 from reaching the electric circuit device 40.

18 Claims, 6 Drawing Sheets

(56) References Cited

U.S. PATENT DOCUMENTS

| | | | | | |
|---|---|---|---|---|---|
| 6,128,394 | A * | 10/2000 | Hayakawa | H04R 1/023 | 181/149 |
| 2003/0034199 | A1* | 2/2003 | Chuang | H04R 1/02 | 181/199 |
| 2005/0058315 | A1* | 3/2005 | Poling | H04R 1/2826 | 381/337 |
| 2005/0089184 | A1* | 4/2005 | Wang | H04R 1/288 | 381/345 |
| 2009/0196450 | A1* | 8/2009 | Hughes | H04R 1/2819 | 381/334 |
| 2010/0074463 | A1* | 3/2010 | Fukunishi et al. | 381/386 | |

FOREIGN PATENT DOCUMENTS

| | | | | |
|---|---|---|---|---|
| JP | 58033392 | * | 2/1983 | 381/332 |
| JP | 05-091089 | U | 12/1993 | |
| JP | 2001-285978 | A | 10/2001 | |
| JP | 2008-187464 | A | 8/2008 | |
| JP | 4560792 | B2 | 10/2010 | |
| TW | I236856 | B | 7/2005 | |

OTHER PUBLICATIONS

Japanese Office Action dated Dec. 17, 2015, for JP Patent Application No. 2012-130062, three pages.

Japanese Office Action drafted Dec. 17, 2015, issued Dec. 22, 2015, for JP Patent Application No. 2012-130062, with English translation, seven pages. (Re-Submit with translation).

* cited by examiner

SPEAKER APPARATUS AND SPEAKER BOX

BACKGROUND OF THE INVENTION

Field of the Invention

The present invention relates to a speaker apparatus suitable for use at a location exposed to water droplets and a speaker box which forms the speaker apparatus.

Description of the Related Art

For conventional speaker apparatuses placed outdoors or indoors, the constant voltage system is employed in many cases in order to prevent power loss over long-distance transmission. In the constant voltage system, as indicated in FIG. 5, an amplifier 1 for amplifying sound signals is provided and a plurality of speaker apparatuses 2 are connected to an output terminal of the amplifier in parallel so that large-amplitude sound signals will be output from the amplifier 1 to the speaker apparatuses 2. For instance, sound signals having the amplitude of 100 volts are supplied to the speaker apparatuses 2. Each speaker apparatus 2 has a step-down transformer 2*a* so that the step-down transformer 2*a* will convert input sound signals into sound signals for use in a common speaker (for instance, a speaker of 4Ω or 8Ω) and will supply the converted signals to its corresponding speaker 2*b*.

As indicated in Japanese Patent Publication No. 4560792, the speaker apparatus of this type has a bass reflex port in a speaker box in order to enhance bass sound properties. Normally, the bass reflex port is shaped like a cylinder so that one end of the bass reflex port is open outside the speaker box, with the other end being open inside the speaker box.

SUMMARY OF THE INVENTION

In a case where the conventional speaker apparatus having the bass reflex port is placed outdoors, the speaker apparatus may encounter intrusion of rain drops (water droplets) through the bass reflex port into the speaker box. The intrusion of rain drops into the speaker box is particularly intense on windy days. In addition, the speaker apparatus placed indoors may also encounter intrusion of water droplets caused by shower or running water through the bass reflex port into the speaker box. To an electric circuit device which is housed in the speaker box and includes the step-down transformer 2*a*, large-amplitude sound signals, that is, sound signals having high voltage are supplied from the amplifier 1. As a result, the conventional speaker apparatus is disadvantageous in that the intrusion of water droplets can cause short circuit in the electric circuit device or failures of the electric circuit device caused by the short circuit.

The present invention was accomplished to solve the above-described problem, and an object thereof is to provide a speaker apparatus which can prevent short circuit in an electric circuit device caused by intrusion of water droplets through a bass reflex port even when the speaker apparatus is used outdoors or indoors in a state where there can be water droplets, and also can prevent failures of the electric circuit device caused by the short circuit. As for descriptions for respective constituents of the present invention described below, numbers corresponding to components of a later-described embodiment are given in parenthesis for easy understanding. However, the respective constituents of the present invention are not limited to the corresponding components indicated by the numbers of the embodiment.

In order to achieve the above-described object, it is a feature of the present invention to provide a speaker apparatus including a speaker box (SB) in which a speaker (51, 52) is placed on a front surface of the speaker box; a bass reflex port (22, 23) formed integrally with the speaker box or installed on the speaker box such that one end of the bass reflex port is open outside the speaker box while the other end is open inside the speaker box; an electric circuit device (40) placed in the speaker box to supply an externally provided sound signal to the speaker; and a drip-proof wall (16, 71 to 74) placed in the speaker box to isolate the electric circuit device from the other end of the bass reflex port.

In this case, for example, the electric circuit device may be placed behind the speaker in the speaker box; and the drip-proof wall may be placed behind the speaker in the speaker box to provide space in which the electric circuit device is placed so that the space is isolated from the other end of the bass reflex port. Furthermore, the drip-proof wall may be a wall having a side which is open to face the speaker. Furthermore, the drip-proof wall may be a wall rising from an inner surface of the speaker box, the inner surface facing the speaker. Furthermore, the drip-proof wall may be arranged such that a speaker side's end of the drip-proof wall is situated closer to the speaker than the other end of the bass reflex port is. Furthermore, the drip-proof wall may have a pair of side walls (16*a*, 16*b*) each extending from an inner surface of the speaker box and a connecting wall (16*c*) which connects respective ends of the pair of side walls with each other to form space surrounded by the pair of side walls and the connecting wall to house the electric circuit device in the space.

According to the speaker apparatus configured as above, in case of rain, particularly when it rains with strong winds, the speaker apparatus may encounter intrusion of rain drops through the bass reflex port into the speaker box. In addition, the speaker apparatus placed indoors may also encounter intrusion of water droplets caused by shower or running water through the bass reflex port into the speaker box. Even in such cases, the electric circuit device is placed in the space isolated from the other end of the bass reflex port by the drip-proof wall, while the drip-proof wall prevents intrusion of water droplets into the space. As a result, the speaker apparatus of the present invention can prevent water droplets from reaching the electric circuit device and can also prevent partial shorts of the electric circuit device and failures of the electric circuit device caused by the shorts. Furthermore, the drip-proof wall placed behind the speaker in the speaker box to provide space behind the speaker can keep resonance frequency in the speaker box low to maintain satisfactory sound properties, particularly, bass sound properties in the speaker box.

It is another feature of the present invention that the speaker box is formed of a cabinet (10) having space inside the cabinet and a baffle board (20) which is installed on a front surface of the cabinet and on which the speaker is installed, while the drip-proof wall is formed integrally with the cabinet. Therefore, the drip-proof wall can be easily provided in the speaker box.

It is the other feature of the present invention to provide a speaker box having a speaker placed on a front plate of the speaker box; and a bass reflex port whose one end is open outside the speaker box and whose other end is open inside the speaker box; wherein space is provided in the speaker box in order to place an electric circuit device which supplies an externally provided sound signal to the speaker, the speaker box including a drip-proof wall which isolates the electric circuit device from the other end of the bass reflex port. In this case, for example, the space may be behind the speaker; and the drip-proof wall is placed behind the speaker in the speaker box to provide the space so that the space is isolated from the other end of the bass reflex port.

The other feature of the present invention is applied to a speaker box which forms a speaker apparatus prior to installation of an electric circuit device. The drip-proof wall isolates the space provided in order to place the electric circuit device from the other end of the bass reflex port. In a state where the electric circuit device has been installed in the speaker box, therefore, similarly to the feature of the present invention, the other feature of the invention can achieve prevention of partial shorts of the electric circuit device caused by water droplets and failures of the electric circuit device caused by the shorts. Furthermore, the drip-proof wall placed behind the speaker to provide space behind the speaker can maintain satisfactory sound properties, particularly, bass sound properties in the speaker box.

DESCRIPTION OF THE PREFERRED EMBODIMENT

Figure 1:
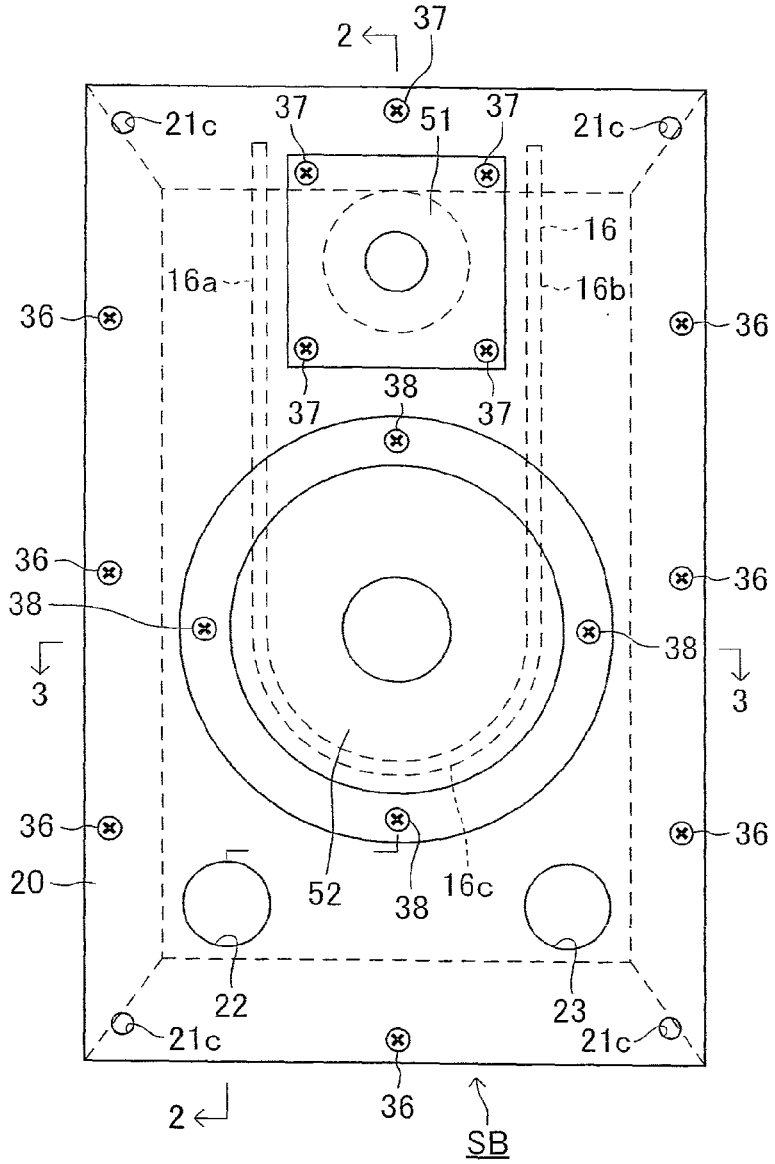
FIG. 1 is a front view of a speaker apparatus according to an embodiment of the present invention.
Figure 2:
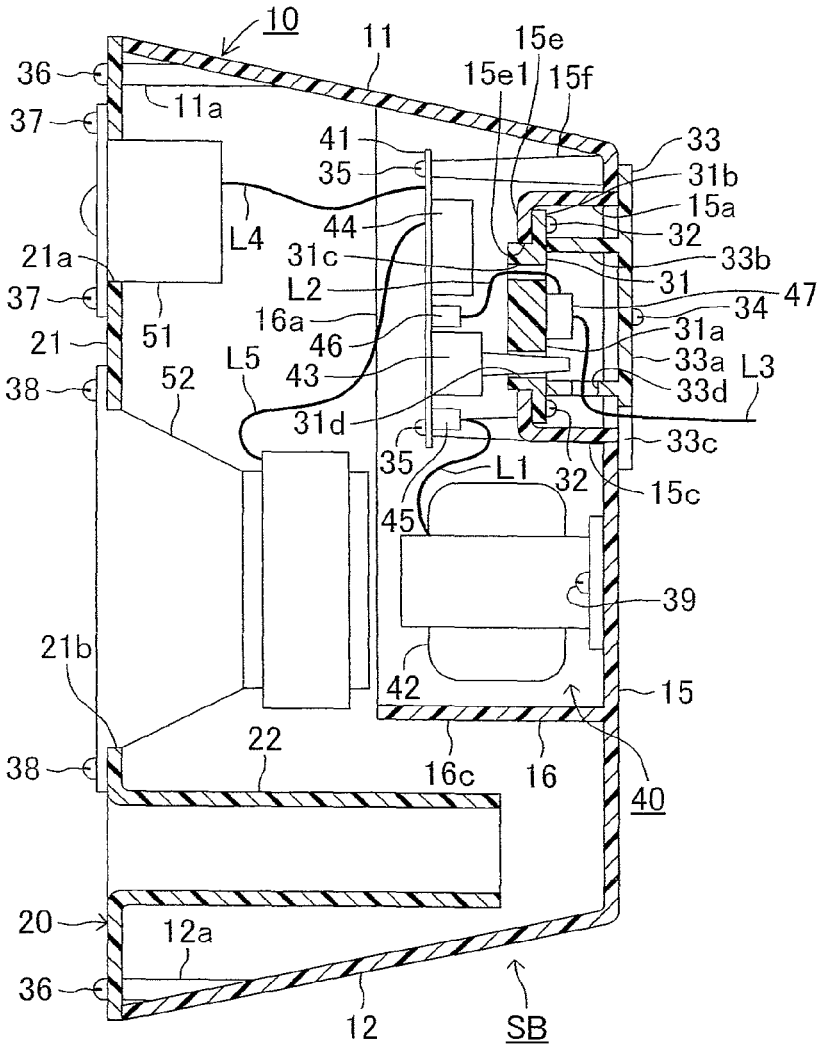
FIG. 2 is a longitudinal sectional view of the speaker apparatus seen along a line 2-2 of FIG. 1.
Figure 3:
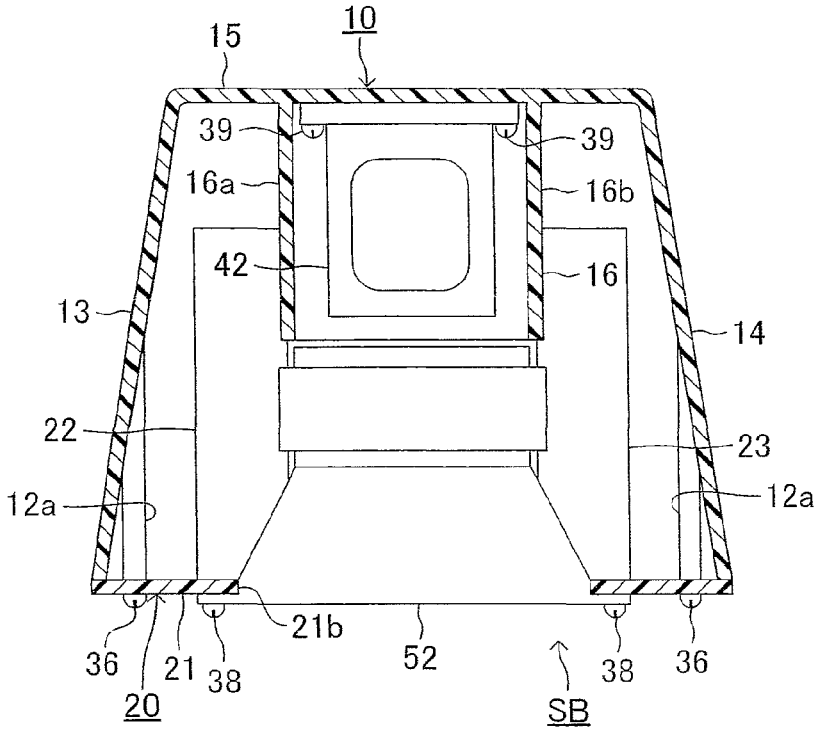
FIG. 3 is a cross sectional view of the speaker apparatus seen along a line 3-3 of FIG. 1.

Hereafter, the speaker apparatus according to the embodiment of the present invention will be explained. FIG. 1 is a front view of the speaker apparatus. FIG. 2 is a longitudinal sectional view of the speaker apparatus seen along a line 2-2 of FIG. 1. FIG. 3 is a cross sectional view of the speaker apparatus seen along a line 3-3 of FIG. 1.

The speaker apparatus has a speaker box SB which is formed of a cabinet 10 and a baffle board 20, and contains space shaped like an approximately quadrangular truncated pyramid therein. The cabinet 10 is formed of an upper portion 11 (upper part in FIG. 2), a lower portion 12 (lower part in FIG. 2), a left portion 13 (left part in FIG. 3), a right portion 14 (right part in FIG. 3), and a bottom portion 15 (right part in FIG. 2 and upper part in FIG. 3), and is formed in one piece of synthetic resin. The upper portion 11 and the lower portion 12 are shaped like a trapezoid which is broad in the front side (left part in FIG. 2 and lower part in FIG. 3) and becomes narrower toward the back side (right part in FIG. 2 and upper part in FIG. 3). The left portion 13 and the right portion 14 are also shaped like a trapezoid which is broad in the front side and becomes narrower toward the back side. Therefore, an opening formed of the upper portion 11, the lower portion 12, the left portion 13 and the right portion 14 in the front side is shaped like a rectangle, so that the cabinet 10 has the quadrangular truncated pyramid shaped space whose cross sectional area becomes gradually narrower from the front side to the back side. The bottom portion 15 is shaped like a rectangle which is smaller than the opening of the front side, and closes the back side of the cabinet 10.

On a part of the bottom portion 15 which corresponds to the back side of the cabinet 10, a rectangular parallelepiped concave portion which is surrounded by four side walls 15*a*, 15*b*, 15*c* and 15*d* (only the side walls 15*a* and 15*c* are shown in FIG. 2) and a bottom wall 15*e*, and faces the front side of the cabinet 10 is provided. The side walls 15*a*, 15*b*, 15*c* and 15*d* and the bottom wall 15*e* are formed integrally with the parts other than the above-described concave portion of the bottom portion 15 to provide the bottom portion 15 formed integrally with the upper portion 11, the lower portion 12, the left portion 13 and the right portion 14. On the central part of the bottom wall 15*e*, a rectangular penetrating hole 15*e*1 is provided.

On the bottom wall 15*e*, a support plate 31 for mounting a connecting terminal 47 which will be described later can be provided. The support plate 31 is a synthetic resin plate integrally formed of a rectangular thick portion 31*a* which has the same shape as the penetrating hole 15*e*1 but is slightly smaller than the penetrating hole 15*e*1, and a rectangular thin portion 31*b* which is provided around the thick portion 31*a* and is larger than the penetrating hole 15*e*1. The support plate 31 is fixed to the bottom wall 15*e* with screws 32 by pressing the thick portion 31*a* into the penetrating hole 15*e*1 of the bottom wall 15*e* from the back side of the cabinet 10 toward the front side of the cabinet 10. The support plate 31 may be fixed to the bottom wall 15*e* not by the screws 32 but by any other way such as bolts, lock pins, or bonding. The support plate 31 has a penetrating hole 31*c* for wiring to the connecting terminal 47, and a penetrating hole 31*d* for allowing an operating element of a later-described impedance selector 43 to protrude from the penetrating hole 31*d*.

On the concave portion of the bottom portion 15, a watertight cover 33 can be mounted. The watertight cover 33 is formed by integrally molding a plate portion 33*a* which is a rectangle similarly to the concave portion but is larger than the concave portion, and rectangular legs 33*b* which form rectangular parallelepiped space inside the legs 33*b*. On the tip of each leg 33*b*, a cushion is provided so that in a state where the watertight cover 33 is mounted on the bottom portion 15, the cushion will be kept in tight contact with the top surface of the support plate 31 to maintain satisfactory watertightness. The watertight cover 33 is fastened to the bottom portion 15 with screws 34 at the right and left sides. For wiring to the connecting terminal 47, furthermore, the plate portion 33*a* has a penetrating hole 33*c*, while the leg 33*b* has a penetrating hole 33*d*.

In the neighborhood of the concave portion of the bottom portion 15, a plurality of bosses 15*f* formed integrally with the bottom portion 15 extend from the inner surface of the bottom portion 15 toward the front side of the cabinet 10. To the respective tips of the bosses 15*f*, an electric circuit board 41 on which electric wiring has been installed is fastened with screws 35.

Inside the cabinet 10, furthermore, a drip-proof wall 16 which is formed integrally with the upper portion 11, the lower portion 12, the left portion 13, the right portion 14 and the bottom portion 15 is provided. The drip-proof wall 16 is formed of a pair of side walls 16*a* and 16*b*, and a connecting wall 16*c* which connects one ends of the side walls 16*a* and 16*b* (lower ends shown in FIG. 1 and FIG. 2) with each other to have the shape of the letter U when seen from the front side of the cabinet 10. The drip-proof wall 16 is designed such that the respective back sides of the side walls 16*a* and 16*b* and the connecting wall 16*c* are connected to the inner surface of the bottom portion 15 to rise vertically from the inner surface of the bottom portion 15 toward the front side to have a uniform height. The other ends (upper ends shown in FIG. 1 and FIG. 2) of the side walls 16*a* and 16*b* situated opposite to the connecting wall 16*c* are connected to the inner surface of the upper portion 11. In other words, the side walls 16*a* and 16*b* extend parallel with each other from the inner surface of the upper portion 11 downward in FIG. 1 and FIG. 2 so that the respective lower ends of the side walls 16*a* and 16*b* are connected with each other by the connecting wall 16*c*, with the respective back sides of the side walls 16*a* and 16*b* and the connecting wall 16*c* being connected with the inner surface of the bottom portion 15. In the cabinet 10, the drip-proof wall 16 configured as described above is open at the front side of the cabinet 10 to provide inner space shaped like the letter U in cross section surrounded by the side walls 16*a* and 16*b* and the connecting wall 16*c*.

The baffle board 20 is integrally formed of synthetic resin to have a front plate 21 and two bass reflex ports 22 and 23. The front plate 21 is configured by a rectangular plate to be fastened to the respective front tips of the upper portion 11, the lower portion 12, the left portion 13, and the right portion 14. For this fastening, bosses (only bosses 11*a* and 12*a* are shown in FIG. 2) formed integrally with the upper portion 11, the lower portion 12, the left portion 13, and the right portion 14 extend from appropriate positions of the inner surface of the upper portion 11, the lower portion 12, the left portion 13, and the right portion 14 toward the front side of the cabinet 10. The front plate 21 is fastened to the upper portion 11, the lower portion 12, the left portion 13, and the right portion 14 with screws 36.

The front plate 21 has circular penetrating holes 21*a* and 21*b*. Into the penetrating hole 21*a*, a tweeter unit 51 which forms the speaker is inserted from the front side of the cabinet 10 so that the side from which tones are emitted will be situated at the front side of the cabinet 10. The tweeter unit 51 is fastened to the front plate 21 with screws 37. Into the penetrating hole 21*b*, a woofer unit 52 which forms the speaker is inserted from the front side so that the side from which tones are emitted will be situated at the front side of the cabinet 10. The woofer unit 52 is fastened to the front plate 21 with screws 38. The front plate 21 has drain holes 21*c* provided at the four corners of the front plate 21.

The bass reflex ports 22 and 23 are shaped like a tube such as a cylinder and extend, at positions situated below the woofer unit 52, from the front side toward the back side of the cabinet 10. The bass reflex ports 22 and 23 are open to the outside on the front plate 21 side, and are also open on the side opposite to the front plate 21 within the speaker box SB. In the speaker box SB, the respective open ends of the bass reflex ports 22 and 23 are situated behind the front end of the drip-proof wall 16. In other words, the height by which the drip-proof wall 16 rises from the bottom portion 15 toward the front is greater than the distance between the open ends of the bass reflex ports 22, 23 in the speaker box SB and the bottom portion 15. The bass reflex ports 22, 23 have a function of decreasing resonance frequency in the speaker box SB in order to provide favorable sound properties, particularly favorable bass sound properties of the speaker box SB.

Next, an electric circuit device 40 provided in the speaker box SB will be explained. The electric circuit device 40 has not only the above-described electric circuit board 41 but also a step-down transformer 42, an impedance selector 43, a cross-over network 44, connectors 45 and 46 and the connecting terminal 47. The step-down transformer 42 is fastened to the bottom portion 15 with screws 39. The impedance selector 43, the cross-over network 44 and the connectors 45, 46 are arranged on the electric circuit board 41. The connecting terminal 47 is placed on the support plate 31.

The step-down transformer 42, which has a primary coil of a high impedance for receiving externally provided sound signals and a secondary coil of a low impedance (impedance that matches the tweeter unit 51 and the woofer unit 52) for inputting sound signals to the tweeter unit 51 and the woofer unit 52, decreases the voltage amplitude of received sound signals and inputs the sound signals to the tweeter unit 51 and the woofer unit 52. The impedance selector 43 is an operating element for switching among a plurality of taps of the step-down transformer 42 to select a tap to which externally provided sound signals will be received. The tip of the operating element protrudes through the penetrating hole 31*d* of the support plate 31 to the concave portion of the bottom portion 15 so that a user can switch the tap in a state where the watertight cover 33 is removed.

The cross-over network 44 separates frequencies of output signals of the secondary side of the step-down transformer 42, generates and outputs sound signals which will be input to the tweeter unit 51 and the woofer unit 52. The connector 45 is to be connected with one end of a connecting line L1 for transmitting signals between the electric circuit board 41 and the step-down transformer 42. The connector 46 is to be connected with one end of a connecting line L2 for transmitting signals from the connecting terminal 47 to the electric circuit board 41. The connecting line L2 passes through the penetrating hole 31*c* of the support plate 31, while the other end of the connecting line L2 is connected with the connecting terminal 47. To the connecting terminal 47, externally provided sound signals will be input through a connecting line L3. The connecting line L3 is drawn to the outside through the penetrating holes 33*c* and 33*d* of the watertight cover 33. The electric circuit board 41 and the tweeter unit 51 are connected with each other by a connecting line L4, while the electric circuit board 41 and the woofer unit 52 are connected with each other by a connecting line L5.

Figure 4:
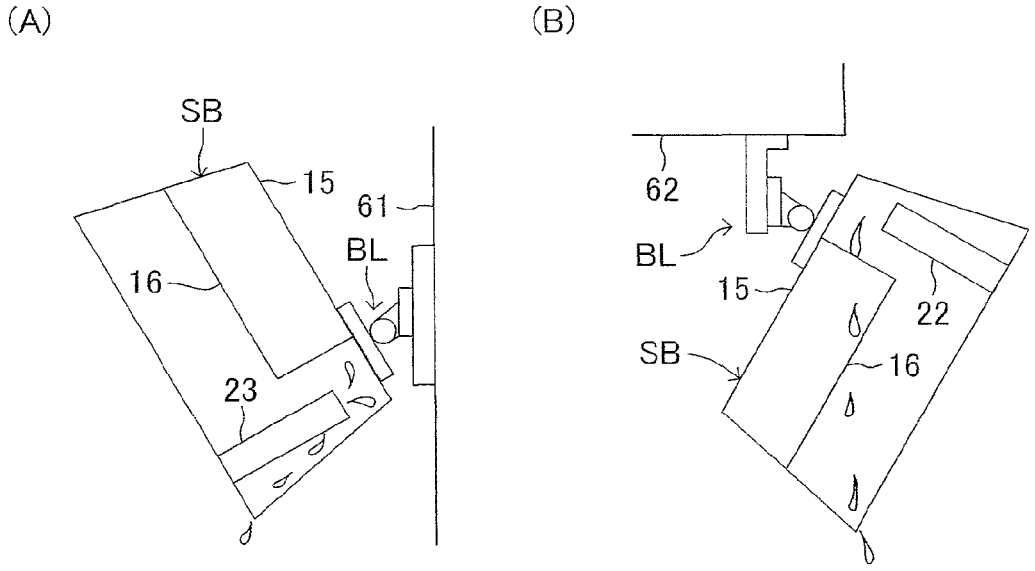
FIG. 4(A) is a schematic view indicating the speaker apparatus mounted on a vertical wall.
FIG. 4(B) is a schematic view indicating the speaker apparatus mounted on a horizontal ceiling.
Figure 5:
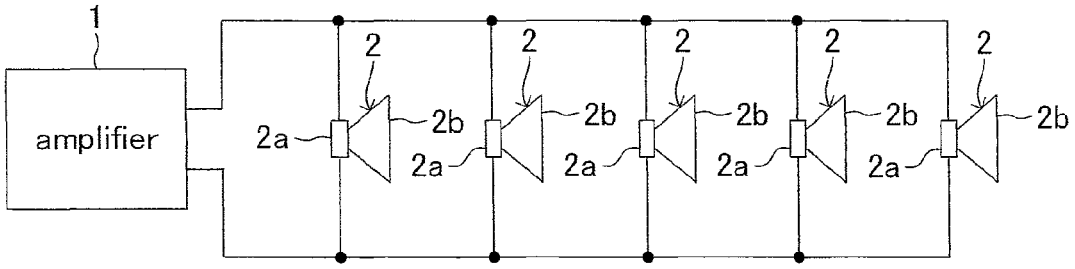
FIG. 5 is a schematic block diagram of a constant voltage system in which sound signals are supplied to a plurality of speaker apparatuses.

In the speaker apparatus configured as described above, a bracket BL which is shown in FIG. 4(A) and FIG. 4(B) but has not been explained above is fastened to the outer surface of the bottom portion 15 of the speaker box SB. The bracket BL has fastening mechanism for fastening the speaker box SB to a building structure and tilt mechanism for changing the angle of the speaker box SB. FIG. 4(A) indicates an example in which the speaker box SB is fastened to a wall 61, while FIG. 4(B) indicates an example in which the speaker box SB is fastened to a ceiling 62.

As for the speaker apparatus configured as above, the user will loosen the screws 34 to remove the watertight cover 33 from the bottom portion 15 of the speaker box SB to connect the connecting line L3 for transmitting externally provided sound signals with the connecting terminal 47 to turn the operating element of the impedance selector 43 to select the tap of the primary coil for receiving externally provided sound signals from among the taps of the step-down transformer 42. Then, the user will put the watertight cover 33 back on the bottom portion 15 of the speaker box SB and will tighten the screws 34 to fasten the watertight cover 33 to the bottom portion 15. Then, by use of the bracket BL, the user will fastens the speaker box SB to the wall 61, the ceiling 62 or the like as indicated in FIG. 4(A) and FIG. 4(B).

In a state where the speaker apparatus has been installed in a building structure, when sound signals are externally supplied through the connecting line L3 to the speaker apparatus, the externally supplied sound signals are supplied to the primary coil of the step-down transformer 42 through the connecting terminal 47, the connecting line L2, the connector 46, wires on the electric circuit board 41, the impedance selector 43, wires on the electric circuit board 41, the connector 45 and the connecting line L1. The voltage amplitude of the sound signals supplied to the primary coil is decreased, so that the decreased sound signals are output from the secondary coil of the step-down transformer 42 to be supplied to the cross-over network 44 through the connecting line L1, the connector 45 and the wires on the electric circuit board 41. The cross-over network 44 separates frequencies of the supplied sound signals, so that the separated sound signals are supplied to the tweeter unit 51 and the woofer unit 52 through the wires on the electric circuit board 41 and the connecting lines L4 and L5. The tweeter unit 51 and the woofer unit 52 emit the supplied sound signals.

In this case, the bass reflex ports 22 and 23 keep favorable sound properties in the speaker box SB, particularly favorable properties of bass sound signal waves of the woofer unit 52. Furthermore, the drip-proof wall 16 is open on the side which is opposed to the woofer unit 52 so that the sound space within the speaker box SB will not be lessened but will be wide, with resonance frequency being kept low in the speaker box SB. Therefore, the speaker apparatus can keep satisfactory sound properties, particularly bass sound properties in the speaker box SB.

In case of rain, particularly when it rains with strong winds, the speaker apparatus placed outside may encounter intrusion of rain drops (water droplets) through the bass reflex ports 22 and 23 into the speaker box SB. In addition, the speaker apparatus placed indoors may also encounter intrusion of water droplets caused by shower or running water through the bass reflex ports 22 and 23 into the speaker box SB. However, the electric circuit device 40 is placed in the space surrounded by the drip-proof wall 16. That is, the electric circuit device 40 is placed in the space isolated from the other ends of the bass reflex ports 22 and 23 by the drip-proof wall 16, while the drip-proof wall 16 prevents intrusion of water droplets (rain droplets) into the space as indicated in FIG. 4(A) and FIG. 4(B). Particularly, the open front end of the drip-proof wall 16 is situated in front of the opening of the bass reflex ports 22 and 23 in the speaker box SB, so that the drip-proof wall 16 can securely prevent intrusion of water droplets into the above-described space. As a result, the speaker apparatus can prevent water droplets from reaching the electric circuit device 40 and can also prevent partial shorts of the electric circuit device 40 and failures of the electric circuit device 40 caused by the shorts.

Furthermore, when the amount of water droplets intruded in the speaker box SB reaches a predetermined level, water accumulated in the speaker box SB by the water droplets will be ejected from the drain holes 21*c* to the outside. Because the drip-proof wall 16 having such functions is formed integrally with the upper portion 11, the lower portion 12, the left portion 13, the right portion 14 and the bottom portion 15 of the cabinet 10, the drip-proof wall 16 can be provided in the speaker box SB easily. Furthermore, the drip-proof wall 16 can serve as a reinforcing member of the cabinet 10 configured by the upper portion 11, the lower portion 12, the left portion 13, the right portion 14 and the bottom portion 15.

Furthermore, the present invention is not limited to the above-described embodiment but can be variously modified without departing from the object of the invention.

In the above-described embodiment, the drip-proof wall 16 is formed of the pair of side walls 16*a*, 16*b* and the connecting wall 16*c* so that the drip-proof wall 16 will be shaped like the letter U when seen from the front side of the cabinet 10. However, the drip-proof wall 16 of the embodiment may be variously modified as long as the drip-proof wall 16 has the functions of keeping satisfactory sound properties in the speaker box SB and of preventing intrusion of water droplets into the electric circuit device 40 through the bass reflex ports 22 and 23. Next, the drip-proof wall according to the various modifications will be explained with reference to drawings.

Figure 6:
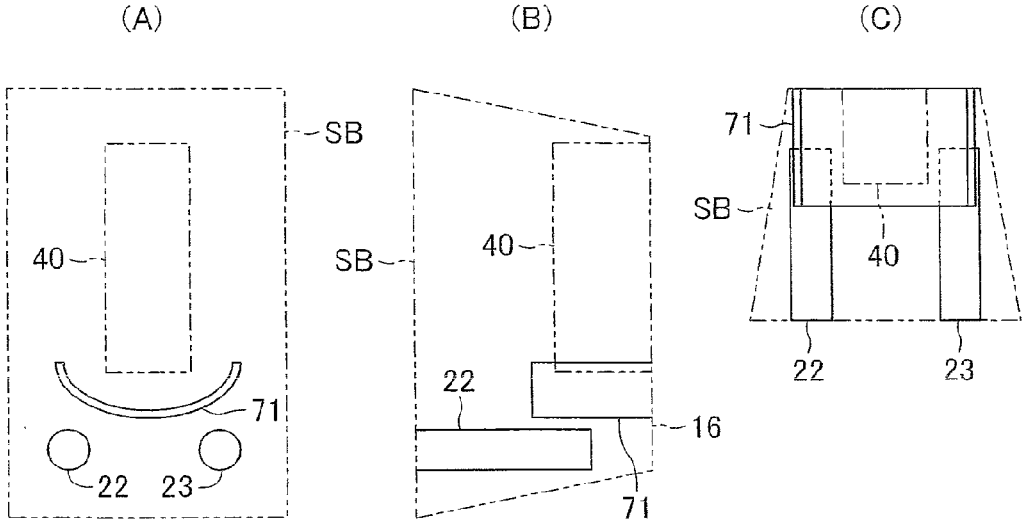
FIG. 6(A) is a schematic front view of a speaker apparatus having a drip-proof wall according to the first modification.
FIG. 6(B) is a schematic side view of the speaker apparatus.
FIG. 6(C) is a schematic top view of the speaker apparatus.

FIG. 6(A) indicates a schematic front view of a speaker apparatus having a drip-proof wall 71 according to the first modification, FIG. 6(B) indicates a schematic side view of the speaker apparatus, and FIG. 6(C) indicates a schematic top view of the speaker apparatus. In FIG. 6(A) to (C), the speaker box SB and the electric circuit device 40 are shown by chain double-dashed lines. The drip-proof wall 71 of the first modification is designed to have an arc-shaped (or an elliptic arc-shaped) longitudinal section which juts downward, extends in the longitudinal direction to have a predetermined thickness, and is formed integrally with the upper portion 11, the lower portion 12, the left portion 13, the right portion 14 and the bottom portion 15 so that the rear end surface of the drip-proof wall 71 will be connected with the bottom portion 15.

The lower end of the drip-proof wall 71 is situated at a position which is slightly higher than the top ends of the bass reflex ports 22, 23, while the top end of the drip-proof wall 71 is situated at a position which is slightly higher than the lower end of the electric circuit device 40. The right and left ends of the drip-proof wall 71 are situated near the right and left ends of the bass reflex ports 22 and 23. The front end of the drip-proof wall 71 is situated in front of the opening ends of the back side of the bass reflex ports 22 and 23, and is situated slightly in front of the front end of the electric circuit device 40. The first modification can also keep satisfactory sound properties in the speaker box SB and prevent intrusion of water droplets from the bass reflex ports 22 and 23 into the electric circuit device 40.

Figure 7:
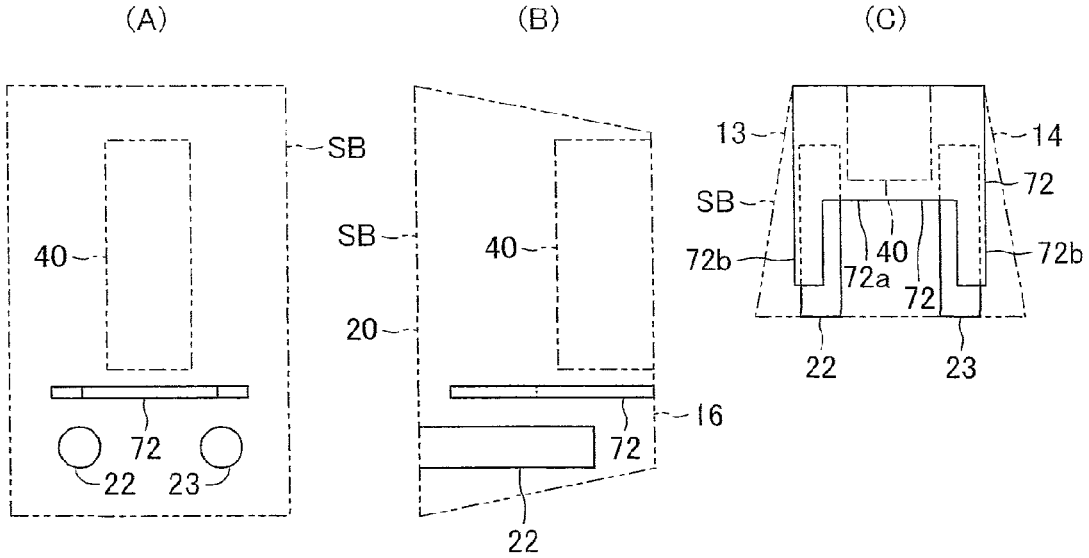
FIG. 7(A) is a schematic front view of a speaker apparatus having a drip-proof wall according to the second modification.
FIG. 7(B) is a schematic side view of the speaker apparatus.
FIG. 7(C) is a schematic top view of the speaker apparatus.

FIG. 7(A) indicates a schematic front view of a speaker apparatus having a drip-proof wall 72 according to the second modification, FIG. 7(B) indicates a schematic side view of the speaker apparatus, and FIG. 7(C) indicates a schematic top view of the speaker apparatus. In FIG. 7(A) to (C) as well, the speaker box SB and the electric circuit device 40 are shown by chain double-dashed lines. The drip-proof wall 72 of the second modification is shaped like a rectangular flat plate having a square notch on the central part of the front end of the flat plate, so that the drip-proof wall 72 has a square base portion 72*a* on the rear, and has a pair of convex portions 72*b* and 72*b* which jut frontward on the right and left sides of the drip-proof wall 72. The drip-proof wall 72 is formed integrally with the upper portion 11, the lower portion 12, the left portion 13, the right portion 14 and the bottom portion 15 so that the rear end surface of the base portion 72*a* will be connected with the bottom portion 15.

The drip-proof wall 72 is situated at a position which is between the top end of the bass reflex ports 22 and 23 and the lower end of the electric circuit device 40. The front end of the base portion 72*a* is situated in front of the opening end of the back side of the bass reflex ports 22 and 23, and is situated slightly in front of the front end of the electric circuit device 40. The respective front ends of the convex portions 72*b* and 72*b* are situated slightly behind the baffle board 20. The right and left ends of the drip-proof wall 72 are situated near the right and left ends of the bass reflex ports 22 and 23. Between the right and left ends of the drip-proof wall 72 and the right portion 14 and the left portion 13, there are clearances. The second modification can also keep satisfactory sound properties in the speaker box SB and prevent intrusion of water droplets from the bass reflex ports 22 and 23 into the electric circuit device 40.

The second modification may be further modified such that the right and left ends of the drip-proof wall 72 are connected to the right portion 14 and the left portion 13, respectively. In addition, the drip-proof wall 72 may be simply shaped like a rectangle to have only the base portion 72*a* without the convex portions 72*b* and 72*b*.

Figure 8:
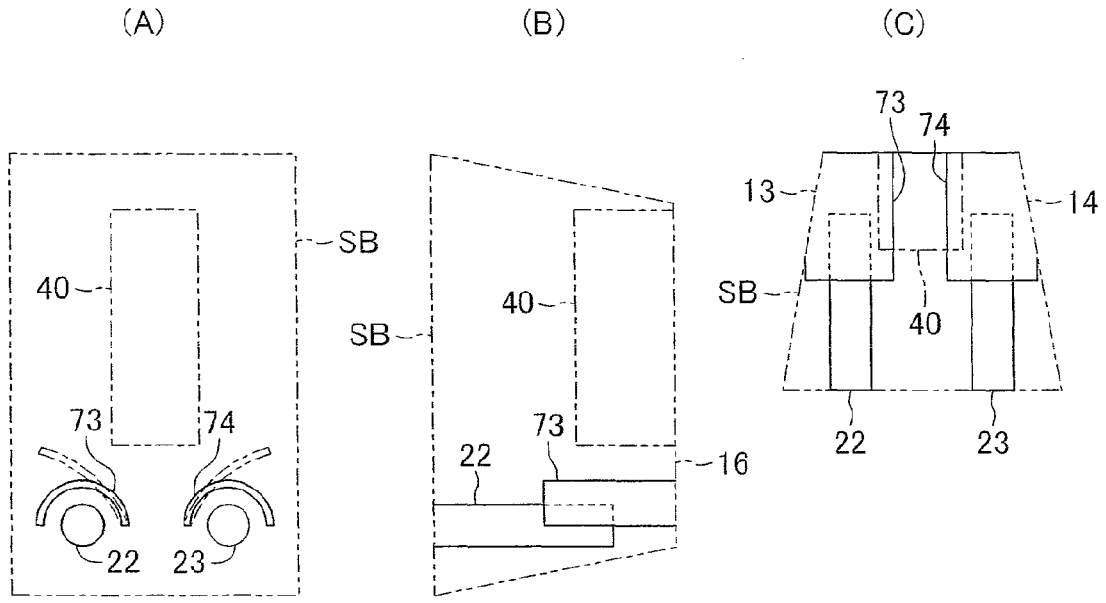
FIG. 8(A) is a schematic front view of a speaker apparatus having drip-proof wall according to the third modification.
FIG. 8(B) is a schematic side view of the speaker apparatus.
FIG. 8(C) is a schematic top view of the speaker apparatus.

FIG. 8(A) indicates a schematic front view of a speaker apparatus having a pair of drip-proof walls 73 and 74 according to the third modification, FIG. 8(B) indicates a schematic side view of the speaker apparatus, and FIG. 8(C) indicates a schematic top view of the speaker apparatus. In FIG. 8(A) to (C) as well, the speaker box SB and the electric circuit device 40 are shown by chain double-dashed lines. Each of the drip-proof walls 73 and 74 of the third modification is designed to have an arc-shaped (or an elliptic arc-shaped) longitudinal section which juts upward, extends in the longitudinal direction to have a predetermined thickness, and is formed integrally with the upper portion 11, the lower portion 12, the left portion 13, the right portion 14 and the bottom portion 15 so that the respective rear end surfaces of the drip-proof wall 73 and 74 will be connected with the bottom portion 15 respectively.

The respective lower ends of the drip-proof walls 73 and 74 are situated at a vertical position which is about the center of the bass reflex ports 22 and 23, respectively, while the respective upper ends are situated at a midpoint between the upper ends of the bass reflex ports 22 and 23 and the lower end of the electric circuit device 40. The right and left ends of the drip-proof wall 73 are situated slightly outside the right and left sides of the bass reflex port 22, while the right and left ends of the drip-proof wall 74 are situated slightly outside the right and left sides of the bass reflex port 23. The front ends of the drip-proof walls 73 and 74 are situated in front of the opening ends of the back side of the bass reflex ports 22 and 23, and are situated slightly in front of the front end of the electric circuit device 40. The third modification can also keep satisfactory sound properties in the speaker box SB and prevent intrusion of water droplets from the bass reflex ports 22 and 23 into the electric circuit device 40.

The third modification may be further modified such that the arc on the longitudinal section of the drip-proof walls 73 and 74 is mild so that the respective inner ends of the drip-proof walls 73 and 74 will be lower than the outer ends as indicated by chain double-dashed lines in FIG. 8(A). The longitudinal section of the drip-proof walls 73 and 74 indicated by chain double-dashed lines in FIG. 8(A) may be modified to be linear so that the drip-proof walls 73 and 74 will be shaped like flat plates, respectively.

In the above-described embodiment, the drip-proof wall 16 is designed to have the longitudinal section shaped like the letter U by the side walls 16*a*, 16*b* and a connecting wall 16*c*. However, the drip-proof wall 16 may have any shape as long as the drip-proof wall 16 can form the space which surrounds the electric circuit device 40. Therefore, there is no necessity to have the longitudinal section shaped like the letter U. For instance, the longitudinal section of the drip-proof wall 16 may be rectangular. In this case, the connecting wall 16*c* will be shaped like a flat plate to be connected with the side walls 16*a* and 16*b*. In the above-described embodiment, furthermore, the drip-proof wall 16 is designed to rise vertically from the inner surface of the bottom portion 15 toward the front side to have a uniform height. However, there is no necessity to make the drip-proof wall 16 rise vertically nor to have a uniform height.

In the above-described embodiment, furthermore, the bass reflex ports 22 and 23 are formed integrally with the front plate 21. However, the bass reflex ports 22 and 23 may be provided separately from the front plate 21, that is, from the baffle board 20 so that the bass reflex ports 22 and 23 will be installed on the front plate 21. Furthermore, the above-described embodiment has the two bass reflex ports 22 and 23. However, the number of bass reflex ports may be one, three or more.

In the above-described embodiment, furthermore, the penetrating holes 21*a* and 21*b* provided on the front plate 21 are round. However, the penetrating holes 21*a* and 21*b* may have a polygonal shape such as a square, a hexagonal shape or an octagon shape. Furthermore, the front plate 21 has the drain holes 21*c* at the four corners. However, the number of drain holes 21*c* can be any number as long as the front plate 21 has at least one drain hole 21*c*. That is, the number of drain holes 21*c* may be any of one to three. Furthermore, the front plate 21 may have five or more drain holes 21*c*.

Furthermore, the above-described embodiment employs a two-way speaker system formed of the tweeter unit 51 and the woofer unit 52 as the speaker apparatus. Instead of the two-way speaker system, however, a full-range speaker system, a three-way speaker system or a different type of speaker system may be applied to the speaker apparatus.

In the above-described embodiment, furthermore, the step-down transformer 42 is used in order to decrease voltage amplitude of externally supplied sound signals. However, an electric circuit such as a voltage amplifier circuit or a signal processing circuit may be used in order to decrease voltage amplitude of externally supplied sound signals.

Furthermore, the above-described embodiment may be modified to provide a detachable net on each front surface of the tweeter unit 51 and the woofer unit 52. In the above-described embodiment, furthermore, although the drain holes 21*c* are provided at the four corners of the front plate 21, the drain holes 21*c* may be provided at any positions as long as the drain holes 21*c* are situated in the vicinity of the four corners. For instance, the drain holes 21*c* may be provided inside or outside the detachable nets. The drain holes 21*c* may be provided not on the front plate 21 of the baffle board 20 but on the upper portion 11, the lower portion 12, the left portion 13 and the right portion 14 of the cabinet 10.

What is claimed is:

1. A speaker apparatus comprising:

a speaker box in which a speaker is placed on a front surface of the speaker box;

a bass reflex port formed integrally with the speaker box or installed on the speaker box such that one end of the bass reflex port is open outside the speaker box while an other end is open inside the speaker box, the other end of the bass reflex port located in the speaker box behind the front surface of the speaker box;

an electric circuit device placed in the speaker box to supply an externally provided sound signal to the speaker, the electric circuit device located in the speaker box behind the front surface of the speaker box; and a drip-proof wall in the speaker box behind the front surface of the speaker box, the drip-proof wall located in between the other end of the bass reflex port and the electric circuit and oriented in a front-to-rear direction in the speaker box to isolate the electric circuit device from the other end of the bass reflex port, the drip-proof wall preventing intrusion of water from the other end of the bass reflex port through the drip-proof wall to the electric circuit.

2. The speaker apparatus according to claim 1, wherein:

the electric circuit device is located behind the speaker in the speaker box; and the drip-proof wall is located behind the speaker in the speaker box to form a space in which the electric circuit device is located.

3. The speaker apparatus according to claim 2, wherein:

an edge of the drip-proof wall forms an opening that faces the speaker.

4. The speaker apparatus according to claim 2, wherein:

the drip-proof wall is a wall rising from an inner surface of the speaker box, the inner surface facing the speaker.

5. The speaker apparatus according to claim 2, wherein:

the drip-proof wall has an end closest to the speaker as a speaker side's end, and the drip-proof wall is arranged such that the speaker is closer to the speaker side's end of the drip-proof wall than to the other end of the bass reflex port.

6. The speaker apparatus according to claim 1, wherein:

the drip-proof wall has a pair of side walls each extending from an inner surface of the speaker box and a connecting wall which connects respective ends of the pair of side walls with each other to form a space surrounded by the pair of side walls and the connecting wall to house the electric circuit device in the surrounded space.

7. The speaker apparatus according to claim 1, wherein:

the speaker box is formed of a cabinet and a baffle board which is installed on the front surface of the cabinet and on which the speaker is installed, while the drip-proof wall is formed integrally with the cabinet.

8. A speaker box having:

a speaker placed on a front plate of the speaker box; and a bass reflex port whose one end is open outside the speaker box and whose other end is open inside the speaker box, the other end of the bass reflex port located in the speaker box behind the front plate of the speaker box, wherein:

a space is provided in the speaker box, behind the front plate of the speaker box, in which to place an electric circuit device for supplying an externally provided sound signal to the speaker, and the speaker box further comprises:

a drip-proof wall behind the front plate of the speaker box, the drip-proof wall located in between the other end of the bass reflex port and the space for the electric circuit and oriented in a front-to-rear direction in the speaker box to isolate the space for the electric circuit device from the other end of the bass reflex port, the drip-proof wall preventing intrusion of water from the other end of the bass reflex port through the drip-proof wall to the space for the electric circuit.

9. The speaker box according to claim 8, wherein:

the space for the electric circuit is behind the speaker; and the drip-proof wall is located behind the speaker in the speaker box to form the space for the electric circuit.

10. A speaker apparatus comprising:

a speaker box in which a speaker is placed on a front surface of the speaker box;

a bass reflex port formed integrally with the speaker box or installed on the speaker box such that one end of the bass reflex port is open outside the speaker box while an other end is open inside the speaker box, the other end of the bass reflex port located in the speaker box behind the front surface of the speaker box;

an electric circuit device placed in the speaker box to supply an externally provided sound signal to the speaker, the electric circuit device located in the speaker box behind the front surface of the speaker box; and a drip-proof wall in the speaker box behind the front surface of the speaker box, the drip-proof wall located in between the other end of the bass reflex port and the electric circuit device to prevent intrusion of water from the other end of the bass reflex port through the drip-proof wall to the electric circuit;

wherein an edge of the drip-proof wall faces toward the front surface of the speaker box, the edge forming a side of one or more openings adjacent the drip-proof wall.

11. The speaker apparatus according to claim 10, wherein:

the electric circuit device is located behind the speaker in the speaker box; and the drip-proof wall is located behind the speaker in the speaker box to form a space in which the electric circuit device is located.

12. The speaker apparatus according to claim 11, wherein:

the edge of the drip-proof wall forms an opening that faces the speaker.

13. The speaker apparatus according to claim 11, wherein:

the drip-proof wall is a wall rising from an inner surface of the speaker box, the inner surface facing the speaker.

14. The speaker apparatus according to claim 11, wherein:

the drip-proof wall has an end closest to the speaker as a speaker side's end, and the drip-proof wall is arranged such that the speaker is closer to the speaker side's end of the drip-proof wall than to the other end of the bass reflex port.

15. The speaker apparatus according to claim 10, wherein:

the drip-proof wall has a pair of side walls each extending from an inner surface of the speaker box and a connecting wall which connects respective ends of the pair of side walls with each other to form a space surrounded by the pair of side walls and the connecting wall to house the electric circuit device in the surrounded space.

16. The speaker apparatus according to claim 10, wherein:

the speaker box is formed of a cabinet and a baffle board which is installed on the front surface of the cabinet and on which the speaker is installed, while the drip-proof wall is formed integrally with the cabinet.

17. A speaker box having:

a speaker placed on a front plate of the speaker box; and a bass reflex port whose one end is open outside the speaker box and whose other end is open inside the speaker box, the other end of the bass reflex port located in the speaker box behind the front plate of the speaker box, wherein:

a space is provided in the speaker box, behind the front plate of the speaker box, in which to place an electric circuit device for supplying an externally provided sound signal to the speaker, and the speaker box further comprises:

a drip-proof wall behind the front plate of the speaker box, the drip-proof wall located in between the other end of the bass reflex port and the space in which the electric circuit device is to be placed to prevent intrusion of water from the other end of the bass reflex port through the drip-proof wall to space for the electric circuit; and wherein an edge of the drip-proof wall faces toward the front plate of the speaker box, the edge forming a side of one or more openings adjacent the drip-proof wall.

18. The speaker box according to claim 17, wherein:

the space for the electric circuit is behind the speaker; and the drip-proof wall is located behind the speaker in the speaker box to form the space for the electric circuit.

* * * * *